US010436386B2

(12) United States Patent
Heon et al.

(10) Patent No.: US 10,436,386 B2
(45) Date of Patent: Oct. 8, 2019

(54) SYSTEMS, DEVICES AND METHODS FOR MODULAR PRESSURE VESSELS

(71) Applicant: AccuAir Control Systems, LLC, San Luis Obispo, CA (US)

(72) Inventors: Reno N. Heon, Grover Beach, CA (US); Dustin B. Heon, Arroyo Grande, CA (US)

(73) Assignee: AccuAir Control Systems, LLC, San Luis Obispo, CA (US)

( * ) Notice: Subject to any disclaimer, the term of this patent is extended or adjusted under 35 U.S.C. 154(b) by 152 days.

(21) Appl. No.: 15/694,701

(22) Filed: Sep. 1, 2017

(65) Prior Publication Data

US 2018/0066796 A1 Mar. 8, 2018

Related U.S. Application Data

(60) Provisional application No. 62/383,266, filed on Sep. 2, 2016.

(51) Int. Cl.
*F17C 1/00* (2006.01)
*F17C 13/04* (2006.01)
(Continued)

(52) U.S. Cl.
CPC ..... *F17C 1/00* (2013.01); *B21C 23/002* (2013.01); *B21C 23/085* (2013.01); *B21C 23/10* (2013.01); *F17C 13/04* (2013.01); *F17C 13/06* (2013.01); *F17C 2201/0119* (2013.01); *F17C 2203/012* (2013.01); *F17C 2205/0311* (2013.01); *F17C 2205/0326* (2013.01);
(Continued)

(58) Field of Classification Search
CPC ..... F17C 13/06; F17C 2203/012; F17C 2203/013; F17C 2203/011; F17C 2203/01; F17C 1/00
See application file for complete search history.

(56) References Cited

U.S. PATENT DOCUMENTS 2,115,361 A 4/1938 Daggett
2,548,934 A 4/1951 Patrick
(Continued)

FOREIGN PATENT DOCUMENTS

WO WO2005015074 * 2/2005

OTHER PUBLICATIONS

SPEC-D, Air Compressor Tank Pump, SKU AH-CMP0015, available at: http://www.speedtuning.com/ah-cmp0015.html, retrieved Aug. 29, 2016.

*Primary Examiner* — Andrew T Kirsch
*Assistant Examiner* — Don M Anderson
(74) *Attorney, Agent, or Firm* — Knobbe Martens Olson & Bear LLP

(57) ABSTRACT

A modular pressure vessel suitable for housing, storage, and/or supplying a pressurized fluid is disclosed. In one aspect, the modular pressure vessel comprises removable end-caps attached to each end of a center section. The center section includes longitudinal rails. In another aspect, methods for manufacturing the modular pressure vessel are described, including extrusion processes for the center section. The modular pressure vessel allows for various components to be easily swapped out or changed, such as the end-caps, or components easily installed and removed from inside the pressure vessel, such as a compressor and related components.

18 Claims, 6 Drawing Sheets

(51) Int. Cl.

| | |
|---|---|
| ***F17C 13/06*** | (2006.01) |
| ***B21C 23/00*** | (2006.01) |
| ***B21C 23/08*** | (2006.01) |
| ***B21C 23/10*** | (2006.01) |

(52) U.S. Cl.

CPC ..... *F17C 2205/0332* (2013.01); *F17C 2205/0391* (2013.01); *F17C 2205/0394* (2013.01); *F17C 2209/2109* (2013.01); *F17C 2209/228* (2013.01); *F17C 2209/234* (2013.01); *F17C 2227/0157* (2013.01); *F17C 2227/0178* (2013.01); *F17C 2260/018* (2013.01)

(56) References Cited

U.S. PATENT DOCUMENTS

| | | | | | |
|---|---|---|---|---|---|
| 2,766,903 | A | | 10/1956 | Boni | |
| 2,860,809 | A | * | 11/1958 | Perry | B65D 90/52 220/563 |
| 2,954,892 | A | * | 10/1960 | Dosker | F17C 3/022 220/560.08 |
| 3,256,069 | A | | 6/1966 | Peterson | |
| 3,279,645 | A | | 10/1966 | Harvey | |
| 3,392,848 | A | | 7/1968 | McConnell et al. | |
| 4,040,284 | A | | 8/1977 | Fuchs, Jr. | |
| 4,715,513 | A | * | 12/1987 | Shelton, Jr. | B65D 90/501 220/4.12 |
| 5,230,539 | A | | 7/1993 | Olson | |
| 5,279,323 | A | * | 1/1994 | Grove | F17C 9/00 137/154 |
| 5,810,309 | A | | 9/1998 | Augustine et al. | |
| 6,056,007 | A | | 5/2000 | Gochenouer et al. | |
| 6,155,524 | A | | 12/2000 | Legler et al. | |
| 6,224,117 | B1 | | 5/2001 | Olson et al. | |
| 6,675,831 | B2 | | 1/2004 | Sakaguchi et al. | |
| 6,834,674 | B2 | | 12/2004 | Koschany et al. | |
| 8,534,467 | B2 | | 9/2013 | Haas et al. | |
| 2005/0103959 | A1 | | 5/2005 | Lee | |

* cited by examiner

SYSTEMS, DEVICES AND METHODS FOR MODULAR PRESSURE VESSELS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. For example, this application claims the benefit of priority of U.S. provisional application No. 62/383,266, filed Sep. 2, 2016, and entitled "SYSTEMS, DEVICES AND METHODS FOR MODULAR PRESSURE VESSELS," the entire contents of which are incorporated herein by reference for all purposes and form a part of this specification.

BACKGROUND

Field

The present disclosure generally relates to pressure vessels, for example, modular pressure vessels.

Description of the Related Art

Pressure vessels contain pressurized fluid, such as air. By "pressurized" it is meant the pressure inside the vessel is greater than the ambient atmospheric pressure. Pressure vessels have many applications, such as in automotive air suspension systems, for portable air supply systems, industrial air tanks, and others. Typical pressure vessels are limited in their capability, where a given vessel structure is suited for only one particular application and cannot be easily changed or expanded for other applications. Existing pressure vessels require complex manufacturing methods and produce unreliable and non-durable fluid retaining structures. Repairs thereto often are required, which are expensive and labor-intensive. There is, therefore, a need for improved pressure vessels and associated methods.

SUMMARY

The embodiments disclosed herein each have several aspects no single one of which is solely responsible for the disclosure's desirable attributes. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing systems, devices and methods for pressure vessels.

Features for systems, devices and methods related to a modular pressure vessel are described. The modular pressure vessel may receive, store and supply pressurized fluids, such as air, gas, etc. By "pressurized" it is meant the pressure inside the vessel is greater than the ambient atmospheric pressure. The development provides a modular pressure vessel that allows for reduced material consumption, manufacturing simplicity, minimal part count, and ease of assembly, among other advantages. The pressure vessel may be manufactured using aluminum extrusion techniques and high speed computer numerical control (CNC) machining techniques. The resulting pressure vessel withstands high pressure requirements for filling, storing and releasing high pressure fluids with less susceptibility to structural failure, such as fatigue.

The present disclosure in some embodiments generally relates to a modular pressure vessel. In some embodiments, the modular pressure vessel comprises multiple parts attached together. The pressure vessel may include removable end-fittings fastened to each end of a hollow center section. The pressure vessel, for example the center section, may include rails. The rails may provide attachment features for adding and removing various components and modules, e.g. end-fittings such as end-caps or instrument caps, to the center section. In some embodiments, the modular pressure vessel can have additional components attached thereto, such as end-fitting-integrated manifolds, control valves, an entirely internally-integrated air compressor, other components, or combinations thereof. Also disclosed are methods for manufacturing a modular multi-piece pressure vessel and components thereof. In some embodiments, the modular multi-piece pressure vessel utilizes an extrusion method. For example, extrusion of metals, such as aluminum, or alloys, may be extruded to integrally form the rails with the center section.

In one aspect, a modular pressure vessel is described. The modular pressure vessel comprises a center section, a plurality of rails, a first end-cap and a second end-cap. The center section has a rounded, longitudinal sidewall. The sidewall defines a longitudinal axis and extends from a first opening at a first end of the center section to a second opening at a second end of the center section that is opposite the first end. The plurality of rails are integral with and extend along the center section parallel to the longitudinal axis from a first end at the first opening of the center section to a second end at the second opening of the center section. Each rail protrudes inwardly from the sidewall, with one or more of the plurality of rails including a first attachment portion at the first end thereof and one or more of the plurality of rails including a second attachment portion at the second end thereof. The first end-cap is configured to removeably attach to the first end of the one or more rails having the first attachment portion. The second end-cap is configured to removeably attach to the second end of the one or more rails having the second attachment portion. The sidewall with attached first and second end-caps define a cavity configured to store therein a pressurized fluid.

In some embodiments, the one or more of the plurality of rails comprises one or more internal attachment portions configured to attach a component in the cavity. In some embodiments, the one or more internal attachment portions comprises a threaded bore extending into the one or more of the plurality of rails. In some embodiments, the modular pressure vessel further comprises a compressor located in the cavity and attached to the one or more internal attachment portions. In some embodiments, one or more of the plurality of rails comprises one or more external attachment portions configured to attach the modular pressure vessel with an external structure. In some embodiments, the first end-cap comprises an electronic solenoid valve. In some embodiments, the first end-cap comprises one or more inlet filters. In some embodiments, the first end-cap comprises a pressure relief valve. In some embodiments, the first end-cap comprises one or more flow control valves. In some embodiments, the first end-cap comprises an electrical bulkhead. In some embodiments, the sidewall comprises a fitting port configured to allow for supply of external air inside the cavity. In some embodiments, the sidewall comprises an electrical bulkhead. In some embodiments, the first end-cap is removeably attached to the first end of the one or more rails having the first attachment portion to seal the first opening, and the second end-cap is removeably attached to the second end of the one or more rails having the second attachment portion to seal the second opening.

In some embodiments, the plurality of rails comprises eight rails each having the first attachment portion at first ends thereof and the second attachment portion at second ends thereof, with the first end-cap configured to removeably attach to the first ends of the eight rails having the first attachment portion to seal the first opening, and the second end-cap configured to removeably attach to the second ends of the eight rails having the second attachment portion to seal the second opening.

In another aspect, a modular pressure vessel is described having a center section, a plurality of rails, a first end-cap and a second end-cap. The center section has a rounded sidewall with an opening extending therethrough defining a longitudinal axis. Each rail of the plurality of rails extends parallel to the longitudinal axis along the center section from a first end to a second end and protrudes away from the sidewall. The first end-cap is configured to removeably attach to one or more of the first ends of the plurality of rails. The second end-cap is configured to removeably attach to one or more of the second ends of the plurality of rails. The sidewall with attached first and second end-caps define a cavity configured to store therein a pressurized fluid.

In some embodiments, the plurality of rails are internal rails located in the cavity. In some embodiments, the one or more of the plurality of rails comprises one or more attachment portions configured to secure a component in the cavity. In some embodiments, the component is a compressor located in the cavity and attached to the one or more attachment portions. In some embodiments, the one or more of the plurality of rails comprises one or more attachment portions configured to attach the modular pressure vessel with an external structure.

In another aspect, a method of manufacturing a modular pressure vessel is described. The method comprises assembling a die and mandrel with an extrusion press, placing a metal dummy block on the extrusion press, and pressing the dummy block through the die and over the mandrel to form a center section. The center section comprises a rounded, longitudinal sidewall and a plurality of rails. The sidewall defines a longitudinal axis and extends from a first opening at a first end to a second opening at a second end that is opposite the first end. The plurality of rails are integral with and extend along the center section parallel to the longitudinal axis from a first end at the first opening of the center section to a second end at the second opening of the center section, with each rail protruding inwardly from the sidewall, and with one or more of the plurality of rails including a first attachment portion at the first end thereof and one or more of the plurality of rails including a second attachment portion at the second end thereof, with the first and second attachment portions configured to removably attach first and second end-caps to define a cavity for storing therein a pressurized fluid. In some embodiments, placing a metal dummy block on the extrusion press comprises placing an aluminum dummy block on the extrusion press. In some embodiments, the method further comprises obtaining a first end cap and integrating with the first end cap one or more of the following: an electronic solenoid valve, a pressure relief valve, a flow control valve and an electrical bulkhead.

In another aspect, a modular pressure vessel is described for accommodating housing, storage, or supplying of a pressurized fluid, the modular pressure vessel comprising a hollow center section and at least one removable end-cap, each comprising a complementary mechanical interlock system operable for forming an airtight seal therebetween when in a coupled state.

In some embodiments, the hollow center section is manufactured into a shape selected from the group consisting of spheroidal, prolate spheroidal, ellipse, ellipsoidal, prolate ellipsoidal, cylindrical, oblate shape, and egg shape. In some embodiments, the complementary mechanical interlock system comprises axial rails and machined female threads in the axial direction for the purpose of bolting the at least one end-cap to the hollow center section. In some embodiments, the complementary mechanical interlock system of the end-cap further comprises an O-ring that seals the outside diameter of the end-cap to a concentric counter bore of the hollow center section. In some embodiments, the complementary mechanical interlock system of the end-cap further comprises an O-ring located under each of the end-cap bolt head. In some embodiments, the modular pressure vessel further comprises a porthole member allowing access to the interior of the modular pressure vessel, with the porthole member mounted upon an exterior wall of the hollow center section and/or upon one of the at least one removable end-cap. In some embodiments, the least one removable end-cap comprises one or more affixing features, porting features, manifold features, and combinations thereof, which enable the integration of one or more additional structural components into the removable end-caps. In some embodiments, the one or more additional structural components integrated into the removable end-caps is selected from the group consisting of solenoid valves, inlet filters, pressure relief valves, electrical bulkheads, and flow control valves.

The foregoing summary is illustrative only and is not intended to be in any way limiting. In addition to the illustrative embodiments and features described herein, further aspects, embodiments, objects and features of the disclosure will become fully apparent from the drawings and the detailed description and the claims.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawing, can be arranged, substituted, combined, and designed in a wide variety of different configurations, all of which are explicitly contemplated and make part of this disclosure.

DETAILED DESCRIPTION OF CERTAIN ILLUSTRATIVE EMBODIMENTS

Figure 1:
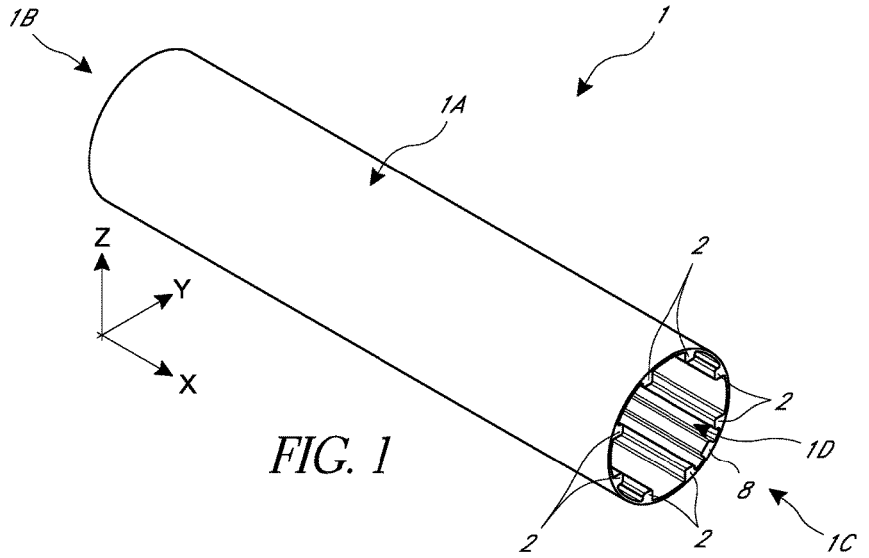
FIG. 1 is a perspective view of an embodiment of a center section for a modular pressure vessel.

The following detailed description is directed to certain specific embodiments of the development. In this description, reference is made to the drawings wherein like parts or steps may be designated with like numerals throughout for clarity. Reference in this specification to "one embodiment," "an embodiment," or "in some embodiments" means that a particular feature, structure, or characteristic described in connection with the embodiment is included in at least one embodiment of the invention. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others. Similarly, various requirements are described which may be requirements for some embodiments but may not be requirements for other embodiments.

Embodiments of the development will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the development. Furthermore, embodiments of the development may include several novel features, no single one of which is solely responsible for its desirable attributes or which is essential to practicing the invention described herein.

The present disclosure generally relates to a modular pressure vessel. The modular pressure vessel may be a multi-piece pressure vessel suitable for various uses such as housing, storing, and/or supplying fluids, such as air, liquids, gas phase materials, etc. The modular pressure vessel may comprise multiple parts attached together. In some embodiments, the modular pressure vessel comprises removable end fittings, such as end-caps, fastened to each end of a hollow center section. The pressure vessel, for example the center section, may include rails. The rails may extend longitudinally along the center section, e.g. internally of the center section. The rails may provide attachment portions are various locations of the rail. The attachment portions may be used for attaching components to, on or in the pressure vessels, and/or for attaching the pressure vessel itself to other structures, such as mounts, supports, etc. The attachment portions may allow for adding and removing various components and modules, such as the end fittings, to the center section. The pressure vessel may include features such as the rails that enable the fastening of end fittings. Such end fittings, may be, for example, end-caps for the purpose of enclosing the pressure vessel and/or attaching modular components therewith. The rails may include mounting features along the lengths thereof, for example external mounting features, such as threads, etc., for the purpose of, for example, mounting the pressure vessel to an object, and/or mounting a number of additional components to the outside of the pressure vessel such as, for example, air compressors, valves, electronic control units, other components, or combinations thereof. In some embodiments, the modular pressure vessel can have alternative and/or additional components attached thereto, such as end-cap-integrated manifolds, control valves, an entirely internally-integrated air compressor, other components, or combinations thereof. The rails may include internal attachment portions, such as threads, etc., for the purpose of, for example, mounting a number of additional components to the inside of the pressure vessel such as, for example, air compressors, valves, electronic control units, other components, or combinations thereof.

Also described are methods for manufacturing a modular multi-piece pressure vessel and components thereof. In some embodiments, the modular multi-piece pressure vessel utilizes an aluminum extrusion method. The center section may be manufactured by an aluminum extrusion process.

In some embodiments, the hollow center section and removable end fittings create a modular pressure vessel into or onto which additional features and components can be modularly integrated as needed for particular applications. Such features and components may include, for example, end-caps with integrated manifolds, control valves, an entirely internally-integrated air compressor, other components, or combinations thereof, which can be incorporated while still offering serviceability and modularity. The modular pressure vessel may integrate a manifold and valves entirely into a modular end-cap. The modular pressure vessel may integrate the entire air compressor into the interior of the modular pressure vessel. The modular pressure vessel can integrate the compressor head directly into an end-cap of the modular pressure vessel. There may be other types of fluid pumps, compressors, etc. integrated with, for example within, the modular pressure vessel.

These are merely some example embodiments of the modular pressure vessel systems, devices and methods described herein. Further details of these and other embodiments are described below. While separate applications and embodiments may be described under separate headings herein, the various embodiments and features under a heading may be combined with other embodiments under other headings or sections.

A. Modular Pressure Vessels

Figure 6:
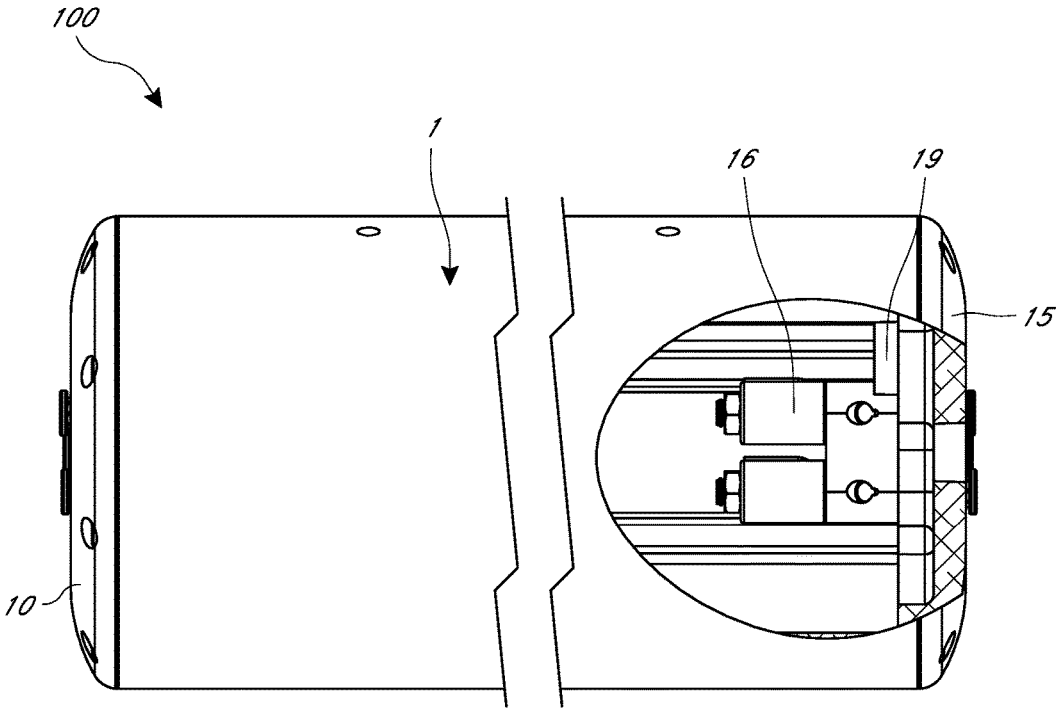
FIG. 6 is a broken side view of an embodiment of a modular pressure vessel having another embodiment of an end-cap integrated with the center section, with a portion of the pressure vessel removed for clarity to show some internal components.

FIG. 1 is a perspective view of an embodiment of a center section 1 for a modular pressure vessel 100, sometimes referred to as a tank. For sake of clarity in description only, and not limiting the scope of the development, a geometric reference axis system indicating mutually orthogonal directions X, Y and Z is shown. The X axis may be referred to as the longitudinal axis. The Y and Z directions may be transverse axes that form a plane perpendicular to the X axis. FIGS. 2A-2D depict two end views (FIGS. 2A and 2C) and two cross-section views (FIGS. 2B and 2D) of several embodiments of the center section 1. The views of FIGS. 2A-2D are in planes that are parallel to the YZ plane. The modular pressure vessel 100, an embodiment of which is shown in FIG. 6, may utilize removable end fittings such as end-caps 10 as shown fastened to both ends of a center section 1 in order to yield a closed pressure vessel 100, as described herein. While certain features and/or functionalities may be described with respect to the pressure vessel 100, the same or similar features and/or functionalities may apply to other embodiments of the pressure vessel, such as the pressure vessels 100, 100A, etc. described herein.

The center section 1 includes a wall 1A, which may be referred to as a sidewall. The wall 1A surrounds and at least partially defines an outer boundary along the longitudinal length (in the X direction) of the center section 1. The center section 1 may be entirely or partially hollow. The center section 1 may be a center portion of the modular pressure vessel 100. In some embodiments, the center section 1 need not be in the geometric center of the pressure vessel 100.

The center section 1 includes a first opening 1B at a first end of the center section 1 and a second opening 1C at a second opposite end of the center section 1. A longitudinal opening extends through the center section 1 from the first opening 1B to the second opening 1C. The wall 1A at least partially forms the openings 1B, 1C. The shape of the openings 1B, 1C may be circular as shown. In some embodiments, the openings 1B, 1C may be different shapes, e.g. polygonal, rounded, partially rounded, partially circular, other shapes, or combinations thereof. The wall 1A may include multiple segments. Thus, there may be multiple thin, longitudinal segments of the wall 1A, for example in between adjacent rails 2 and/or 8 (as further described herein).

The center section 1 may define a cavity 1D therein. The interior side of the wall 1A may define the cavity 1D or portions thereof. The openings 1B, 1C at either end may be at the end of the cavity 1D. A fluidly connected passageway extends through the cavity 1D from the first opening 1B to the second opening 1C. In some embodiments, the cavity 1D may be compartmentalized, such that there are multiple cavities 1D, which may or may not be in fluid communication with each other. The cavity 1D may be defined by end-caps 10 when end-caps 10 are attached to the ends of the center section 1.

The center section 1 generally can have any hollow shape that enables housing and/or storage of a fluid, e.g. gas phase material. The center section 1 as shown has a cylindrical shape. The center section 1 may have other shapes such as, for example, cylindrical shape, ellipsoidal shape, other rounded shapes, shapes with less-rounded wall segments, shapes with more straight wall segments, other shapes, or combinations thereof. The openings 1B, 1C may have corresponding shapes. In some preferred embodiments, the center section 1 is for a cylindrical pressure vessel 100 (see, e.g., FIG. 6) and has a circular or generally circular cross section. In some embodiments, the center section 1 can include a non-circular cross-section with structural webs that essentially connect multiple circular cross sections together yielding a reservoir (e.g., the pressure vessel) that is of a more flattened shape. This may be, for example, for the benefit of being able to package the pressure vessel 100 into smaller and flatter areas in an integrated system such as, for example, a vehicle.

The center section 1 may have a variety of sizes or ranges of sizes. The inner width, e.g. inner diameter, of the center section 1 as measured in the YZ plane and/or planes parallel thereto may be various sizes or ranges of sizes. In some embodiments, the inner width may be from about three inches to about one hundred inches, from about four inches to about fifty inches, from about five inches to about thirty-six inches, from about six inches to about twenty-four inches, from about six inches to about twelve inches, or other greater or smaller ranges or sizes. In some embodiments, the inner width may be about six inches. In some embodiments, the inner width is 6.365 inches. The inner width of the center section 1 may be uniform or non-uniform, as measured in any angular direction in the YZ plane or in planes parallel thereto. For instance, there may be internal features, such as rails as further described, which may result in a smaller inner width as measured at various angular orientations of the center section 1.

The center section 1 may have a length measured along the X-axis from the first opening 1B to the second opening 1C that is of various sizes or ranges of sizes. This length may be from about six inches to about one hundred inches, from about eight inches to about seventy-two inches, from about ten inches to about sixty inches, from about eleven inches to about forty-eight inches, from about twelve inches to about thirty-six inches, from about twelve inches to about twenty-four inches, or other greater or smaller ranges or sizes. In some embodiments, the length is about thirty inches. In some embodiments, the length is about twenty inches. In some embodiments, the length is thirty inches. In some embodiments, the length is twenty inches.

The sidewall 1A of the center section 1 may have a thickness measured in the YZ plane or planes parallel thereto that is of various sizes or ranges of sizes. This thickness may be from about 0.001 inches to about 1 inch, from about 0.010 inches to about 0.5 inches, from about 0.1 inches to about 0.25 inches, or other greater or smaller ranges or sizes. In some embodiments, the thickness is about 0.125 inches. In some embodiments, the thickness is 0.125 inches.

In some embodiments, the modular pressure vessel 100 utilizes a pressure vessel center section 1, which may be manufactured by a method of extrusion. In some embodiments, aluminum extrusion is used. As shown in FIG. 1 and FIGS. 2A-2D, the minimum radial wall 1A thickness of this extruded center section 1 may be determined by the maximum pressure requirements for the pressure vessel 100. FIGS. 2A-2D also illustrate numerous features integrated within the extruded center section 1, as further described herein. FIGS. 2A-2D also illustrate numerous features that may be post process machined into the extruded center section 1, as further described herein.

In some embodiments, the center section 1 includes one or more rails 2 and/or 8. The rails 2 and/or 8 may be longitudinal rails that extend axially along the X-axis as indicated at least partially along the longitudinal length of the center section 1. The rails 2 and/or 8 may extend for part of, or the entire length of, the center section 1 in the X-direction. The rails 2 and/or 8 may protrude inward toward the cavity 1D away from the sidewall. Thus the rails 2 and/or 8 may be inner or internal rails. The rails 2 and/or 8 may or may not protrude in a radial direction and/or toward the geometric center, e.g. of a cross-section of the sidewall 1A as taken in the YZ plane. As shown, some of the rails 2 extend in directions parallel to the Y direction and some of the rails 2 extend in directions parallel to the Z direction. In some embodiments, the rails 2 and/or 8 may protrude outward away from the sidewall 1A, for example outer or external rails. In some embodiments, the rails 2 and/or 8 may protrude both inward and outward. The rails 2 and/or 8 may protrude in such directions in a radial direction. The rails 2 and/or may protrude in such directions away from the sidewall 1A but in a non-radial direction. "Radial" here means along a radius as measured from a geometric center of the center section 1, e.g. a center located along a central longitudinal axis parallel to the X-axis and defined by the sidewall 1A, whether the sidewall 1A is circular or otherwise shaped. As shown, the rails 2 extend inward in non-radial directions and the rail 8 extends inward in a radial direction.

The rails 2 and/or 8 may protrude in the various directions for a variety of heights. The "height" here may refer to a direction that is parallel to the direction of inward or outward extension of the rail, which may or may not be a radial direction, for example from the sidewall 1A (such as inner our outer surface thereof) to an inner/outer flat edge of the rail 2 and/or 8 located away from the sidewall 1A. For non-radial rails, this may be measured along the short or long side of the rail 2 and/or 8. This height may be from about 0.1 inches to about four inches, from about 0.2 inches to about three inches, from about 0.25 inches to about two inches, from about 0.325 inches to about 1.5 inches, from about 0.4 inches to about one inch, from about 0.5 inches to about 0.75 inches, or other greater or smaller ranges or sizes. In some embodiments, the height may be about 0.5 inches. In some embodiments, the height is 0.5 inches. The rails 2 and/or 8 may have a variety of widths. "Width" here refers to a direction transverse to the height, as described. This width of the rails 2 and/or 8 may be from about 0.1 inches to about three inches, from about 0.2 inches to about two inches, from about 0.5 inches to about 1.5 inches, from about 0.75 inches to about 1.25 inches, from about 0.8 inches to about one inch, or other greater or smaller ranges or sizes.

There may be eight rails 2 and one rail 8, as shown. There may be fewer or more such rails 2, 8. The rails 2 may be the same or similar to the rails 8. In some embodiments, there may be fewer than eight or more than nine total rails 2, 8. There is no limit in the number of rails 2 and/or 8 that can be incorporated into the hollow center section 1. This number of axial rails 2 and/or 8 can vary depending on specific downstream applications of the final pressure vessel 100. The rails 2 and/or 8 may be thicker than the minimum radial wall thickness. The rails 2 and/or 8 may be distributed around the inner circumference of the center section 1.

In some embodiments, the rails 2 and/or 8 may be integral with the wall 1A of the center section 1. The center section 1 may be formed by extruding a material, such as aluminum or other metals or alloys, to form the wall 1A and the rails 2 and/or 8 integrally together as one monolithic piece. The rails 2 and/or 8 may thus be integral with the wall 1A and/or with other portions of the center section 1. In some embodiments, some or all of the rails 2 and/or 8 or portions thereof may be separate from the wall 1A and attached thereto.

The rails 2 and/or 8 may provide extra thickness to the wall of the center section 1. Extra thickness from the rails 2 and/or 8 may facilitate post process machining of features, such as one or more attachment portions, such as the female threads 3 as shown, in the axial (X-axis) direction. Such attachment portions may be for the purpose of attaching end fittings, such as bolting the end-caps 10, 15, to the ends of the center section 1. The rails 2 and/or 8 may be post process machined away at one or both ends of the center section 1. The rails 2 and/or 8 may be post process machined away at each of the center section 1 ends, for example, to yield concentric counter bores 4 with smooth surface finishes. The bores 4 may be for the purpose of incorporating one or more seals 11. The center section 1 may be installed in a specific rounding fixture throughout the machining of the concentric counter bores 4, for example to prevent or mitigate high out of round tolerance resulting from the aluminum extrusion process.

The rails 2, 8 may include attachment portions or features that allow for attaching components inside the pressure vessel 100. The rails 2, 8 may include attachment features that allow for attaching components outside the pressure vessel 100. The rails 2, 8 may include attachment features that allow for securing the pressure vessel 100 to a mount, support or other structure, such as an automotive support structure, etc. The various attachment features described herein may be used for attaching components in or on the pressure vessel 100, including attaching the pressure vessel 100 to other structures, or vice versa.

Figure 3:
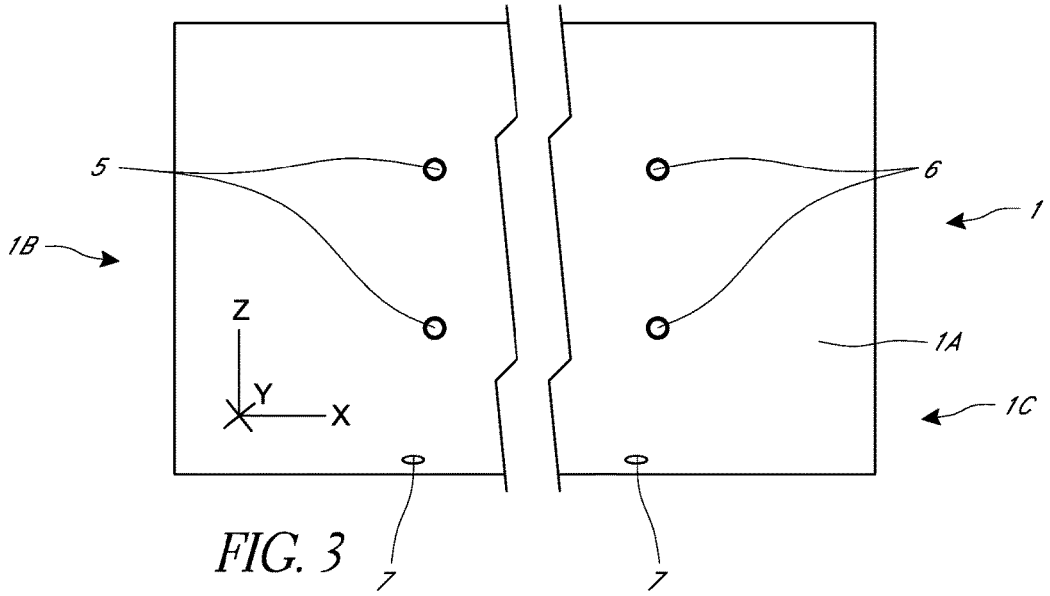
FIG. 3 is a broken side view of another embodiment of a center section for a modular pressure vessel.

FIG. 3 is a broken side view of the pressure vessel center section 1. Attachment features, shown as threads 5,6,7, may be female mounting threads. Other type of attachments alternatively or in addition to threads may be used. There may be fewer or more than the six female mounting threads 5,6,7 shown. In some embodiments, the threads 5,6,7 may be different types of threads and or attachment types, such as male threads, fasteners, hooks, latches, etc. The extruded internal rails 2 may also facilitate, for example provide, the material required for machining the female threads 5,6,7.

The threads 5,6,7 may be used for the purpose of mounting the pressure vessel 100 to an object and/or mounting other components to the outside of the pressure vessel 100. Such components may include for example an electric air compressor(s), electronic solenoid valves, electronic control units, or other components. It may be desirable to integrate a means for the control of supplying the compressed fluid into the pressure vessel 100. For example, the safety of such a pressure vessel 100 having a fluid such as a gas can be increased considerably by fitting a pressure relief valve into the pressure vessel 100.

Figure 2A:
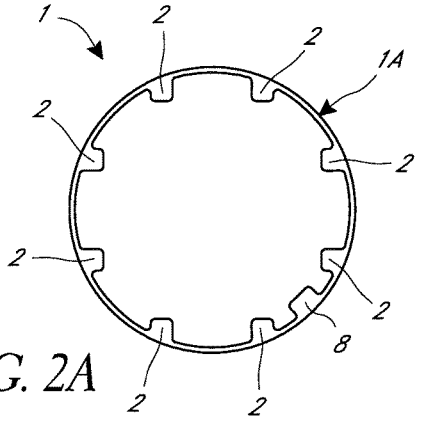
FIGS. 2A-2D depict several end views and cross-section views of several embodiments of the center section of FIG. 1.
Figure 2C:
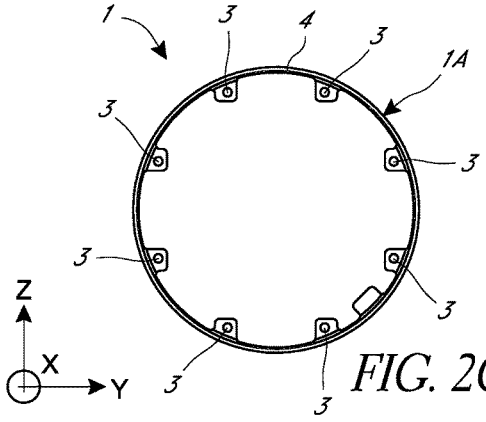
Figure 2B:
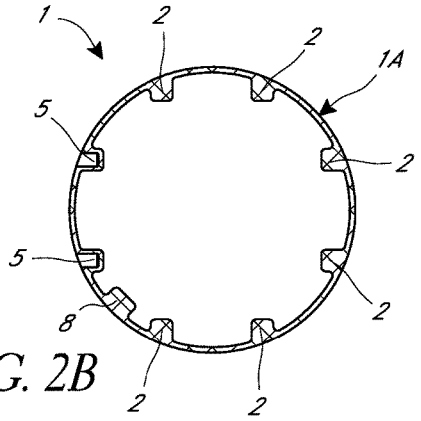
Figure 2D:
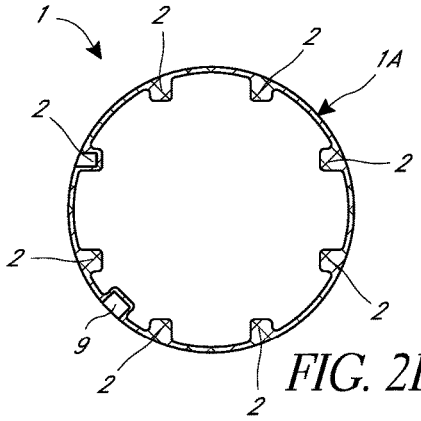

In some embodiments disclosed herein, the mounting threads 5,6,7 are post process machined from the outside of the center section 1 in one or more of the transverse (Y-Z) directions. The threads 5,6,7 may be post process machined without breaching through the inner wall 1A as to avoid any additional sealing requirements. Such threads 5,6,7 may therefore be "blind" threaded holes extending into thicker portions of the wall 1A corresponding to locations of the rails 2 and/or 8. Additional rails, such as axial rails 8 or other rails, can be included within the center section 1 extrusion for the purpose of post process machining female threaded fitting bosses 9, as shown in FIG. 2D.

Figure 4A:
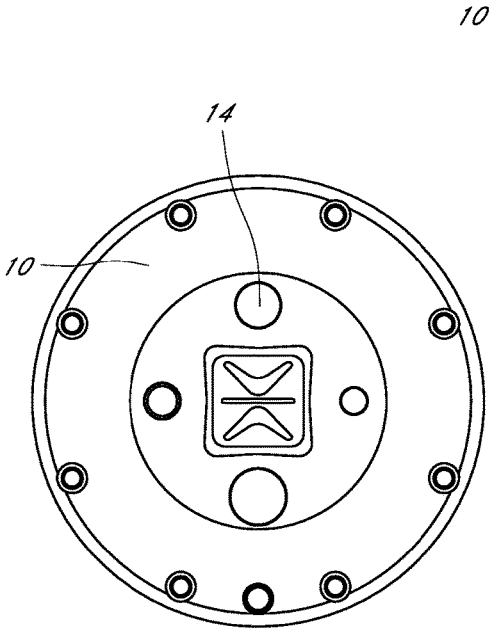
FIGS. 4A and 4B depict, respectively, front and perspective views of an embodiment of an end-cap which may be used with the center section of FIG. 1 for a modular pressure vessel.
Figure 4B:
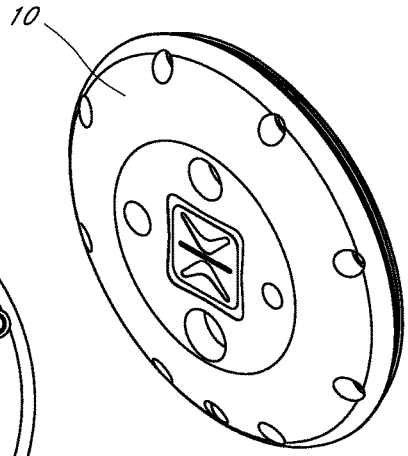
Figure 5A:
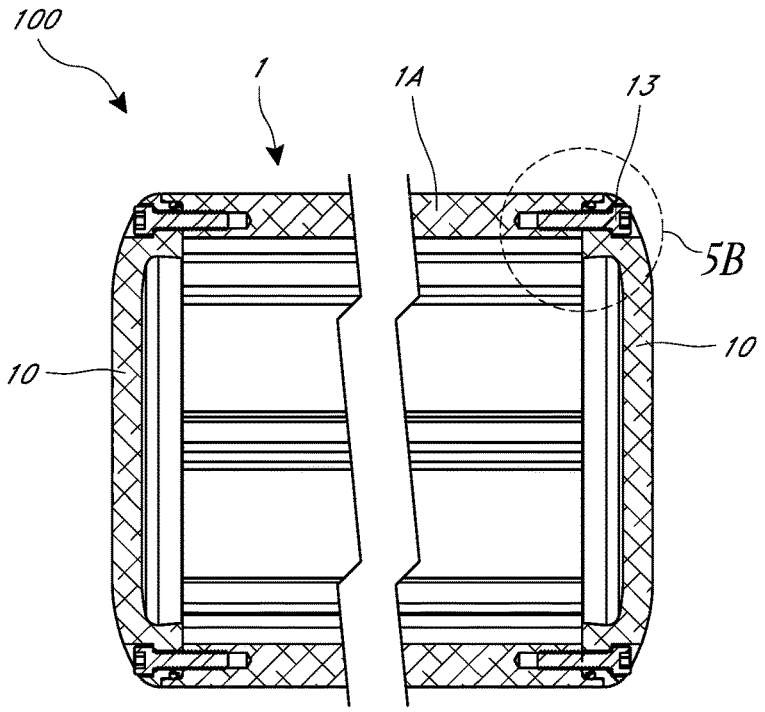
FIG. 5A is a broken, longitudinal cross-sectional view of an embodiment of a modular pressure vessel incorporating the center section of FIG. 1 and the end-cap of FIG. 4 attached to two ends of the center section.
Figure 5B:
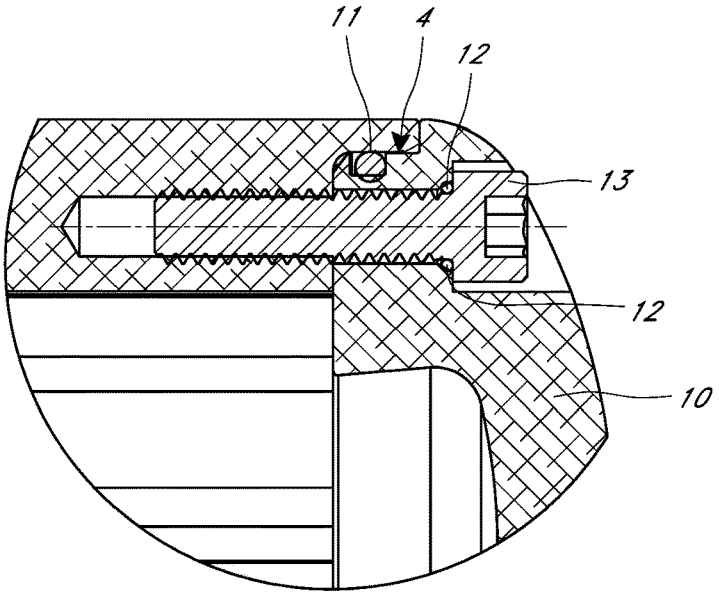
FIG. 5B is a detail view the region 5B identified in FIG. 5A and showing a detail of an interface between the center section and an end-cap.

FIG. 4 depicts front and perspective views of an embodiment of the end fitting, shown as the end-cap 10, which may be used with the center section 1 for a modular pressure vessel 100. FIG. 5A is a broken longitudinal cross-sectional view of the modular pressure vessel 100 incorporating the center section 1 and two of the end-caps 10 attached to two ends of the center section 1. FIG. 5B is a detail view showing a detail of an interface between the center section 1 and an end-cap 10, taken from the portion 5B identified in FIG. 5A.

The end-caps 10 may be used to seal the ends of the center section 1. The end-caps 10 may be swapped with other end fittings or end-caps, such as the integrated end-caps 15 having components, instruments, etc. integrated therewith, as described herein. Thus, the end-caps 10 may be modular such that other components may be used with the same center section 1. Further, features described herein with respect to the end-caps 10 are understood to apply equally to other end fittings that may be incorporated, such as the end-caps 15, etc. Any and all embodiments of the end fittings, including the end-caps 10 and 15, may have a variety of sizes or ranges of sizes. The end fittings may have a width, for example a diameter, measured in the YZ plane or planes parallel thereto when installed with the center section 1, that is from about two inches to about twelve inches, from about three inches to about ten inches, from about four inches to about eight inches, from about five inches to about seven inches, or other greater or smaller ranges or sizes. In some embodiments, the width of the end fitting is about 6.5 inches. In some embodiments, the width of the end fitting is 6.615 inches.

As shown in FIGS. 5A and 5B, the end-caps 10 can include seals 11 and 12. Seals 11, 12 may assist for example with achieving highly reliable sealing of the center section 1. The removable end-cap 10 may be mounted on each end of the center section 1. A fastening mechanism incorporating the seals 11 and/or 12 may provide sealing between the center section 1 and the removable end-caps 10. A series of fasteners, such as the bolt 13 shown, may attach the end-cap 10 to the center section 1, e.g. to ends of the corresponding rails 2 and/or 8. The seals 12 may be located under each of the end-cap bolt 13 heads. The center section 1 can include concentric counter bores 4 at the ends thereof for receiving therein corresponding end-caps 10. In some embodiments, the end-caps 10 can include the seals 12 as well as the seal 11 that seals the outside diameter of the end-caps 10 to the concentric counter bores 4 of the center section 1.

The seals 11 and/or 12 may be a variety of different types of seals. In some embodiments, the seals 11 and/or 12 may be or include O-rings. The seals 11 and/or 12 may be annular O-rings. In some embodiments, the seals 11 and/or 12 may be or include gaskets. The seals 11 and/or 12 may be other types of seals, including adhesives, sealants, gas sealing washers, flange gaskets, O-ring boss seals, other types of seals, or combinations thereof. The seals 11 and/or 12 may be formed from rubber, polymer, plastic, other suitable materials, or combinations thereof. The seals 11 and/or 12 may be replaceable. There may be one seal 11 and eight seals 12 incorporated with each end-cap. In some embodiments, there may be fewer than or greater than one seal 11 and eight seals 12.

FIG. 6 is a broken side view of another embodiment of the modular pressure vessel 100 having the end-cap 10 and an end-cap 15 integrated with the center section 1, with a portion of the pressure vessel 100 removed for clarity showing internal components. The pressure vessel 100 may have at least one integrated end-cap 15 or 10 fastened to an end of the hollow cylindrical center section 1. As shown, the end-cap 10 is attached to one end of the center section 1 and the end-cap 15 is attached to the opposite end of the center section 1. The end-cap 15 is an embodiment of an "integrated" end-cap that has various features integrated in, on or otherwise with the end-cap 15. The intergrated end-cap 15 may include any of a number various features, for example manifolding components, porting components, affixing features, electrical bulkheads, other components, or combinations thereof. These and other features may enable the integration of additional integrated components to the pressure vessel 100, such as to the pressurized side (interior) of the pressure vessel 100, and/or for connecting tubes or other components to the exterior, etc. Further detail of the integrated end-cap 15 is described herein, for example with respect to FIG. 7A and 7B.

Figure 7A:
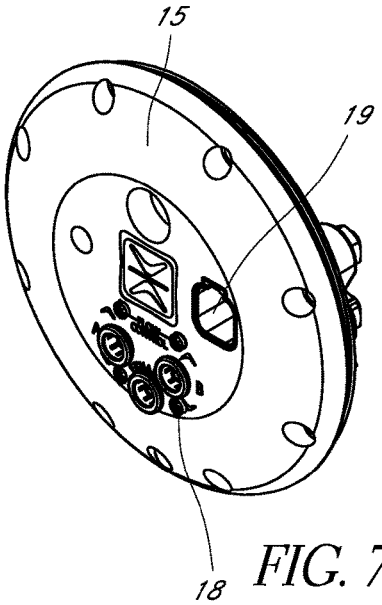
FIGS. 7A and 7B are, respectively, front and rear perspective views of the end-caps of FIG. 6, shown detached from the center section.
Figure 7B:
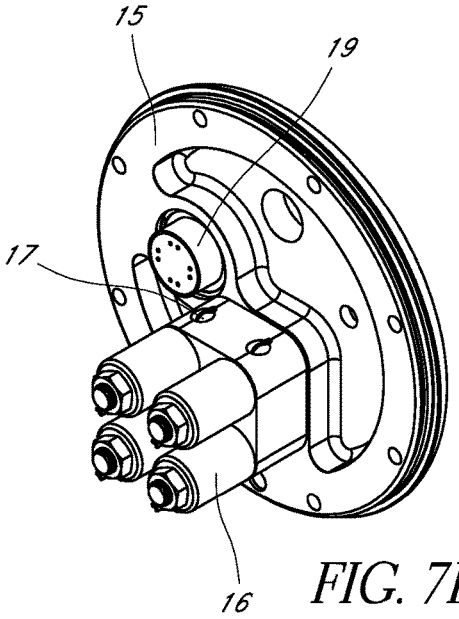

FIGS. 7A and 7B show, respectively, front and rear perspective views of the end-cap 15, shown detached from the center section 1. The atmospheric (external) side of the end-cap 15 is shown in FIG. 7A as oriented and the pressurized (internal) side of the end-cap 15 is shown in FIG. 7B as oriented. The end-cap 15 may include various integrate features. As shown in the exemplary embodiment, the end-cap 15 includes electronic solenoid valves 16, inlet filters 17, flow control valves 18, and a high pressure electrical bulkhead 19. Further details of the end-cap 15 and example integrated components are provided herein, for example in the section "Integrated End-Cap Assembly."

In some embodiments, the end-cap bolts 13 are specifically torqued to create a preload between the center section 1 and the end-caps 10 and/or 15 that is greater than the axial end-cap force experienced at the maximum operating pressure of the pressure vessel 100. This may yield zero end-cap 10, 15 displacement during operational pressure cycling between minimum and maximum operating pressures. In some embodiments, the end-caps 10, 15 can also include one or more machined female fitting bosses 14 (e.g. see FIG. 4).

Embodiments of the pressure vessels 100 according to this aspect and other aspects of the disclosure can, in addition or alternatively to features described herein, include one or more other features. For example, in certain embodiments, the center section 1 can include rails mounted to the outside (e.g., the non-pressurized side) of the pressure vessel 100. External rails may be similar to the rails 2 and/or 8 except the external rails extend along the outside of the center section 1. The center section 1 may include both external and internal rails 2 and/or 8. Any external rails may or may not angularly align, in planes parallel to the YZ plane (See FIGS. 1 and 2A-2D), with any internal rails 2 and/or 8. For instance, any external rail may or may not be located radially outward from a corresponding internal rail 2 and/or 8, as viewed in a plane perpendicular to the YZ plane. In some embodiments, any and all external rails may radially align in this manner with corresponding internal rails 2 and/or 8.

In certain embodiments, one or more of a variety of other sealing features and/or methods, in addition or alternatively to the sealing features and/or methods described herein, may be used. For example, a sealing mechanism involving a face seal at the end of the center section 1 that may or may not include the sealing of the end-cap bolts 13 may be used. In some embodiments, a sealing mechanism may be used involving an annular seal between the outside diameters of the center section 1 that requires an end-cap with a larger outside diameter than the center section 1. In some embodiments, the sealing mechanism of the pressure vessel 100 can include the use of a flexible bladder that encompasses the entire internal volume of the pressure vessel 100.

In some further embodiments, the wall 1A or segments thereof of the center section 1 can be further configured to allow "porthole" access to the inside of the pressure vessel 100 (e.g., center section 1 of the pressure vessel 100). In some particular embodiments, the "porthole" access to the inside of the pressure vessel 100 can be a porthole in an end-cap 10, 15. In some other particular embodiments, the "porthole" access to the inside of the tank can be achieved via an access cover incorporated in the wall 1A of the tank. In yet other embodiments, getting access to the inside of tank can be achieved by splitting the body of the center section 1 into one or more portions and then rejoining them with any one of known methods such as, for examples, with a V-band, a threaded joiner, or via radial bolting. Thus, in some embodiments, the extruded center section 1 may then be cut or otherwise machined into separate portions that are then attached together.

B. Integrated End-Cap Assembly

In some embodiments the pressure vessel 100 includes one or more integrated end-cap assemblies, such as the end-cap 15, having additional structural components. In some embodiments of the disclosure, the integrated end-cap 15 assembly can be configured for allowing installation and service of additional components of the pressure vessel 100 which are internally integrated inside of the pressure vessel 100. The one or more structural components integrated in the end-cap 15 assembly can generally be any structural components and can be, for example, components configured directly into the removable end-caps 15 for performing functions that would typically be controlled by auxiliary devices that are external and separate from the pressure vessel 100. These functions can include lifting or lowering vehicle suspension air springs, turning an auxiliary air powered device on or off, or venting to atmosphere on demand.

Examples of structural components that can be suitably integrated into the removable end-caps 15 include, but are not limited to, manifolding components, solenoid valves such as the electronic solenoid valves 16, flow control valves such as the flow control valves 18, bulkheads such as the high pressure electrical bulkhead 19, other components, or combinations thereof.

In some embodiments, the solenoid valve can be an electromechanically operated valve, where the valve is controlled by an electric current through a solenoid. In some embodiments, the solenoid valve can be a two-port valve where the flow is switched on or off. In some embodiments, the solenoid valve can be a three-port valve where the outflow is switched between the two outlet ports. In some embodiments, multiple solenoid valves can be placed together on a manifold.

In some embodiments, the flow control valves can be generally any suitable valve, for example, shut-off valves, pressure-reducing valves, preferably diaphragm controlled, fusible cut-outs, residual-pressure valves, through-flow control valves, fill-valves, high pressure blow off valves, other valves, or combinations thereof.

Accordingly, in some preferred embodiments disclosed herein, the integrated end-cap 15 assembly can include specific manifolding, porting, and/or affixing features incorporated within the material of the integrated end-caps 15 themselves. As illustrated in FIGS. 6 and 7A-7B, these manifolding, porting, and/or affixing features enable the integration of additional structural components such as, for example, electronic solenoid valves 16, inlet filters 17, flow control valves 18, and an annularly sealed high pressure electrical bulkhead 19 for the purpose of passing electrical signals from the atmospheric side (external) to the pressurized side (internal) of the pressure vessel. In some embodiments, one or more of the manifolding, porting, and/or affixing features can be configured such that they are completely positioned internally to the pressure vessel (e.g., within) for the benefit of simplified appearance and better use of external packaging space. Other components alternatively or in addition to these shown may be integrated with the end-cap 15, such as a pressure relief valve.

One of the advantages achieved by the modular design of the pressure vessel 100 disclosed herein is to allow for the same center section 1 to be utilized with either a non-integrated end-cap 10, or an integrated end-cap 15, which in turn offers the customer benefit of being able to upgrade, customize, or reconfiguring the pressure vessels 100 as desired.

In addition or alternatively, in some embodiments, the pressure vessel 100 can include the integration of one or more of manifolding components, electronic solenoid valves, and flow control valves integrated directly into the material of the end-caps yet exposed completely external (e.g., atmospheric side) to the pressure vessel (outside). In these instances, the pressure vessel 100 may not require the high pressure electrical bulkhead as described above, but may not offer the same visual appeal when compared to the pressure vessel 100 having these additional components integrated inside (e.g., pressurized side) of the pressure vessel. Various methods may be used to manufacture or otherwise assemble the various end-caps and center section 1, for example as described herein with respect to FIGS. 10A-10D.

C. Pressure Vessel with an Electric Air Compressor Integrated Internally

In one aspect, some embodiments disclosed herein relate to the modular pressure vessel 100 with the integration of an electric air compressor mounted entirely inside of the pressure vessel 100. In some particular embodiments of this aspect, the pressure vessel 100 may include the integration of one or more removable end-caps in order to install and service the integrated air compressor.

Figure 8:
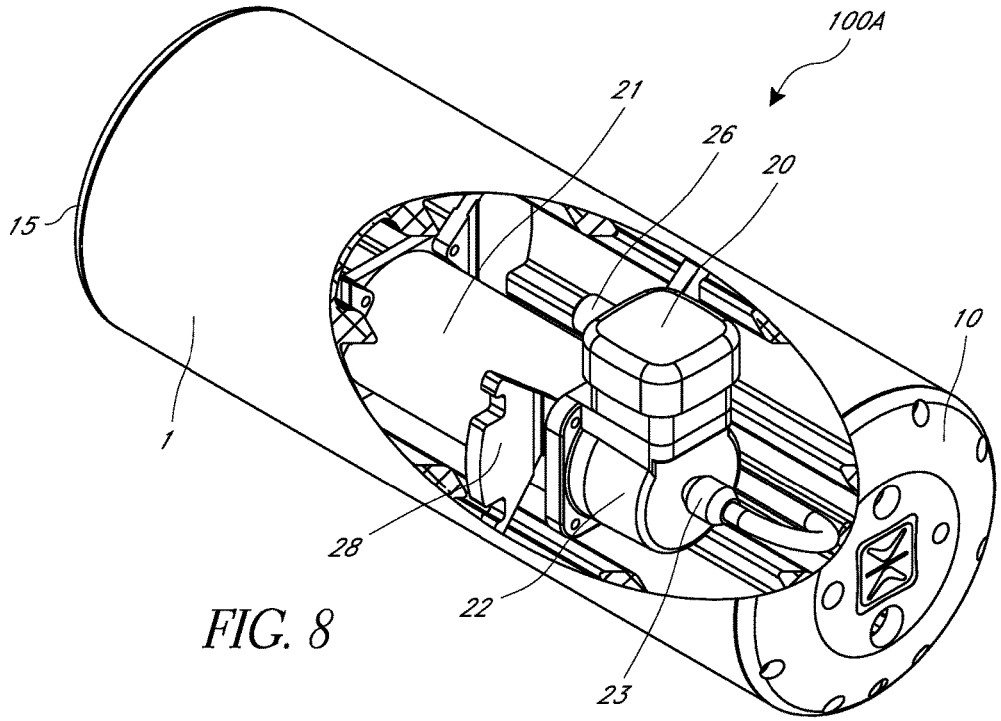
FIG. 8 is a perspective side view of another embodiment of a modular pressure vessel, with a portion of the body removed for clarity to show some internal components.
Figure 9:
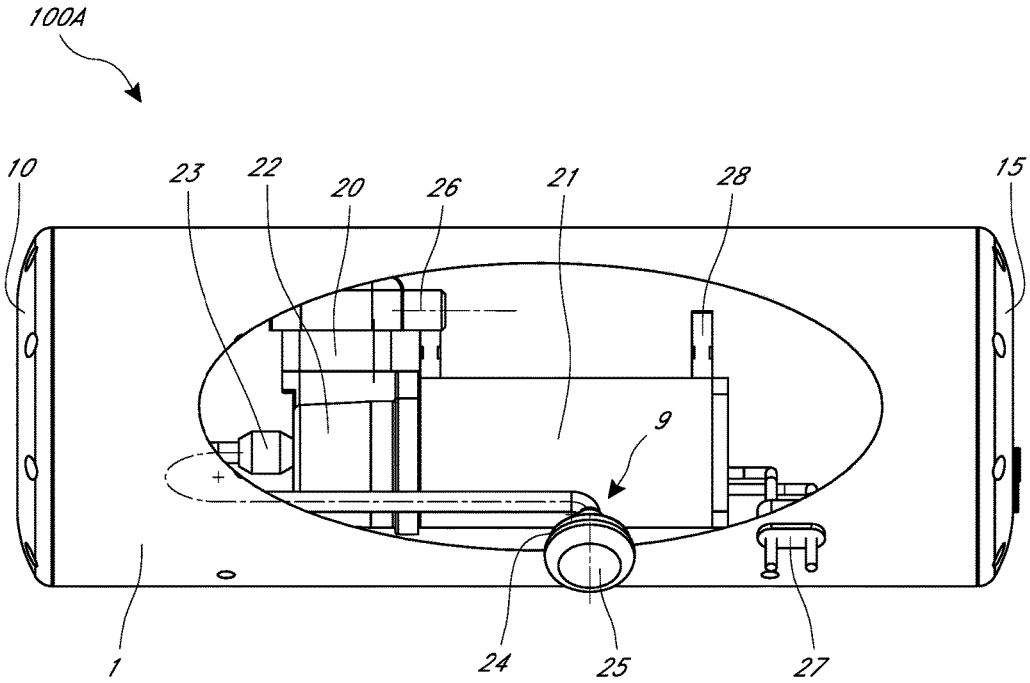
FIG. 9 is a schematic top plan view of the pressure vessel of FIG. 8, with a portion of the body removed for clarity to show some internal components.

FIG. 8 is a perspective side view of another embodiment of a modular pressure vessel 100A, with a portion of the body (e.g. center section 1 and end-cap 10) removed for clarity showing internal components. The body may include the wall 1A of the center section 1, and/or other features of the pressure vessel 100. FIG. 9 is a schematic top plan view of the pressure vessel 100A with two removable end-caps fastened to the center section.

Referring to FIGS. 8 and 9, the pressure vessel 100A may have the same or similar features and/or functionalities as the pressure vessel 100, and vice versa. The pressure vessel 100A may be the exact same as the pressure vessel 100 but with a compressor and other features inside the pressure vessel 100A, as described herein. The pressure vessel 100 is thus modular and the exact same pressure vessel 100 may be used in many different applications, with various components attached thereto or therein, etc.

As shown in FIGS. 8 and 9, the modular pressure vessel 100A can be configured to encompass the entire air compressor 22. The compressor 22 may include a compressor head 20 and a compressor electric motor 21. The compressor 22 may be enclosed completely within the cavity 1D bounded by the center section 1 and end-caps 10, 15 of the enclosed pressure vessel 100A. The two removable end-caps 10, 15 are also shown fastened to the hollow cylindrical center section 1 of the pressure vessel 100, showing a number of additional integrated components in accordance with some embodiments of the disclosure.

In some embodiments, an air supply inlet for the air compressor 22 is plumbed to a fitting port 9 through a high-vacuum flexible joint and tube 23. This may allow the air compressor 22 to stay flexible with respect to the center section 1. In some embodiments, atmospheric air enters the fitting port 9 through a valve 24, such as a check valve or electronic solenoid valve. This may allow for blocking pressurized air from inside the pressure vessel 100A from leaking out of the inlet when the air compressor 22 is not running. In some embodiments, air can be supplied to the valve 24 from an externally mounted air filter 25, for example for the purpose of easy filter servicing.

In some embodiments, the incoming air is compressed by the air compressor 22 and then enters the pressurized section of the pressure vessel 100 via the air compressor output port 26. In some embodiments, a high pressure electrical bulkhead 27 can be utilized to pass electrical power and electrical signals through the center section 1 to the compressor 22. The bulkhead 27 may be located at one of the rails 8 of the pressure vessel 100.

In some embodiments, a structural isolator 28 is incorporated. The isolator 28 may be a novel metallic and polymer mounting isolator 28 non-rigidly affixing the air compressor 22, and/or portions thereof such as the compressor head 20 and/or compressor electric motor 21, to the center section 1. Such isolation may reduce or attenuate the noise and dynamic mechanical loads and/or vibration transmitted from the air compressor 22 to the center section 1 and/or end fittings. Therefore, the modular pressure vessel 100 provides significant advantages in ease of installing fewer components, improved appearance, and most importantly reduced air compressor noise heard or felt by the user.

In some embodiments, the air compressor head 20 can be incorporated directly into one of the end-caps 10, 15 itself with the compressor electric motor 21. In certain embodiments, the electric motor 21 can be affixed inside of the pressure vessel 100A, as exemplified and illustrated in FIGS. 8 and 9. In an alternate embodiment, the compressor electric motor 21 can be affixed outside of the pressure vessel 100A. Therefore, the configurations shown an described are merely some example embodiments of the modular pressure vessel 100 and associated features.

D. Methods of Manufacture and Assembly

In another aspect, the present disclosure relates to a method for manufacturing and assembling the modular pressure vessel 100. In some embodiments, the pressure vessel center section 1 can be manufactured by an extrusion process. As used herein, extrusion is a process that may be used to create objects of a fixed cross-sectional profile. The extrusion process can be done with the material hot or cold.

Some advantages of the manufacturing processes described herein for the modular pressure vessel 100 include processes that do not require excessive heating steps, such as, for example, welding. In some embodiments, the materials and finishes required for the modular design of the pressure vessel 100 do not require them to survive the excessive heat of welding. Further, extrusion may create very complex cross-sections for the center section 1. Extrusion may also allow for working materials for the center section 1 that are brittle, as the material may only encounters compressive and shear stresses. Extrusion may also form center sections 1 with an excellent surface finish.

Figure 10A:
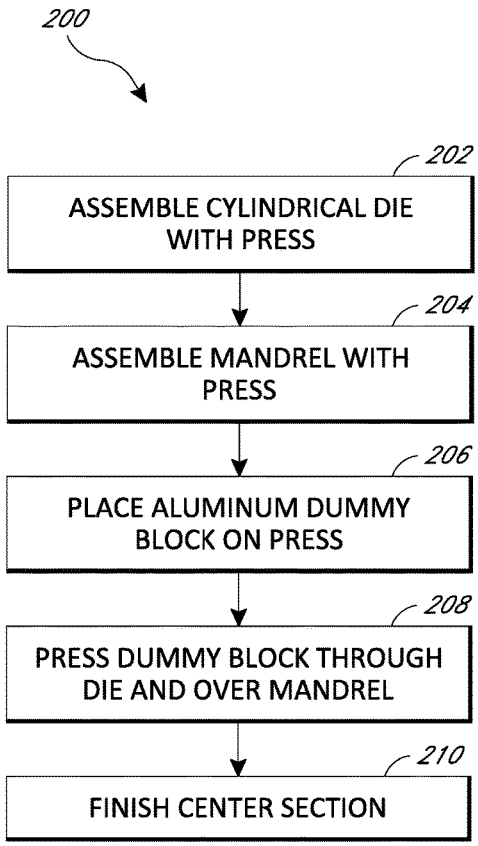
FIGS. 10A-10D are flow charts showing embodiments of methods for manufacturing and/or assembling a modular pressure vessel or components thereof.

FIGS. 10A-10D are flow charts showing embodiments of methods 200, 220, 230, 240 relating to manufacturing and/or assembling the modular pressure vessel 100 or components thereof. FIG. 10A is a flow chart showing an embodiment of a method 200 for manufacturing an embodiment of the center section 1. In the extrusion process, a material such as aluminum may be pushed through a die of the desired cross-section.

The method 200 begins with step 202 wherein a die is assembled with an extrusion press. The die may be cylindrical in shape, for example to form the outer surface of the center section 1. The die may therefore be a metal plate or disc with an opening having a size similar or identical to the outer diameter of the sidewall 1A of the center section 1. In some embodiments, the opening in the die may have notches, lips, or other features, for example to form external rails or other features on the outside of the sidewall 1A of the center section 1. In some embodiments, the die may be in the shape of a cylinder with depth, beginning first with a shape profile that supports the center section. The die shape may then internally change along its length into the final shape, with the suspended center pieces supported from the back of the die. The material may flow around the supports and fuses together to create the desired closed shape (for example where one end of the modular pressure vessel 100 is sealed and only one modular/removeable end fitting is desired).

The method 200 then moves to step 204 wherein a mandrel is assembled with the extrusion press machine. In some embodiments, various extrusion processes may be used to create the cavity 1D (see FIG. 1) within the center section 1. In some embodiment, a hollow billet with a mandrel inside may be used. The mandrel may be fixed, floating, or semi-floating. A fixed mandrel, also known as a German type, may integrated into a dummy block and stem. A floating mandrel, also known as a French type, may float in slots in a dummy block and align itself in the die when extruding. In some embodiments, a solid billet may be used as the feed material, which may first be pierced by the mandrel before extruding through the die. A special press may be used in order to control the mandrel independently from the ram. The solid billet could also be used with a spider die, porthole die or bridge die. All of these types of dies may incorporate the mandrel in the die and have "legs" that hold the mandrel in place.

The method 200 then moves to step 206 wherein a dummy block is placed on the extrusion press. In some preferred embodiments, the material used in the extrusion process is aluminum. As used herein, the term "aluminum" includes both aluminum and aluminum alloys. Materials suitable for the extrusion process in accordance with some embodiments of the manufacturing methods disclosed herein may include lead, tin, aluminum, copper, zirconium, titanium, molybdenum, beryllium, vanadium, niobium, steel, alloys thereof, other materials or alloys thereof, or combinations thereof. In some embodiments, a billet may be used as the dummy block, such as a pre-formed aluminum log. The dummy block may be long enough to make one or more center sections 1 in a single press.

The method 200 then moves to step 208 wherein the dummy block is pressed through the die. In some embodiments, the dummy block may be pressed over the mandrel, for example as it is pressed through the die. The extrusion of the center section 1 may be continuous or semi-continuous. In some embodiments, during extrusion the metal may divide, flow around the legs, then merge, leaving weld lines in the final product. In some embodiments, weld lines may be aligned with the rails 2 and/or 8 as opposed to the sidewall 1A region, for example, for sufficient strength of material, thickness, weld competency, etc. In some embodiments, there may be eight legs that each align with a corresponding one of eight rails 2 and/or 8. These are just some examples, and other extrusion processes may be used or incorporated, including but not limited to impact extrusion (either reverse, forward, or combination), direct extrusion (e.g. the die is held stationary and the ram moves towards die), indirect extrusion (e.g. the ram is held stationary and the die moves towards the ram), hydrostatic extrusion, hot extrusion, warm extrusion, cold extrusion, friction extrusion, other types, or combinations thereof.

The method 200 then moves to step 210 wherein the center section is finished. Step 210 may include machining attachment features, such as threaded holes, etc. Such features may be incorporated into the rails, as described herein. Step 210 may include interior and/or exterior surface finishing of the center section 1. Step 210 may include treatments such as electrochemical, etc.

Figure 10B:
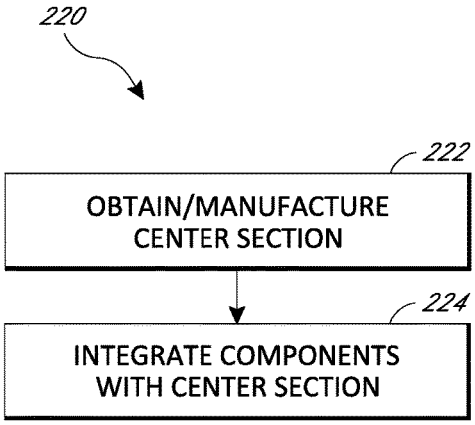

FIG. 10B is a flow chart showing an embodiment of a method 220 for assembling an embodiment of the center section 1. The method 220 may begin with step 222 wherein a center section 1 without any integrated components therein is manufactured or otherwise obtained. Step 222 may be accomplished using the method 200 described in FIG. 10A.

The method 220 then moves to step 224 wherein one or more components are integrated with the center section 1. Step 224 may include attaching an air compressor inside the center section 1, for example by fastening it with bolts through holes formed in the rails. Various tubing and other features that may be internal to the modular pressure vessel 100 as described herein may also be attached in step 224. In some embodiments, features may be attached to the exterior of the center section 1 in step 224.

Figure 10C:
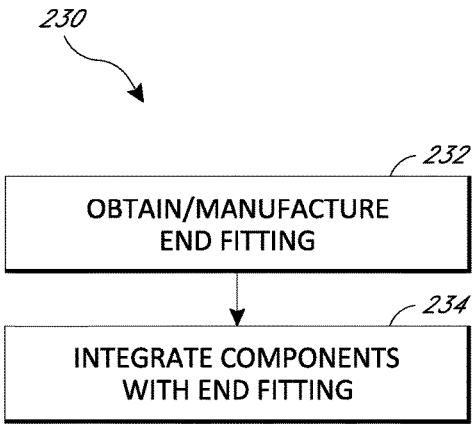

FIG. 10C is a flow chart showing an embodiment of a method 230 for assembling an embodiment of the end fitting. The method 230 may begin with step 232 wherein an end fitting is manufactured or otherwise obtained. The end fitting, such as the end-cap 10 or 15, may be machined or manufactured with a variety of methods or equipment, for example with a mill, lathe, press, stamp, cast, forged, injection molded, etc. The end fitting may be metal or other materials, such as those described with respect to materials for the center section 1.

The method 230 may then move to step 234 wherein one or more components may be integrated with the end fitting. In step 234, the electronic solenoid valves 16, the inlet filters 17, the flow control valves 18, and the high pressure electrical bulkhead 19 may be integrated, for example fastened, adhered, etc. to the end fitting, such as the end-cap 10 or 15.

Figure 10D:
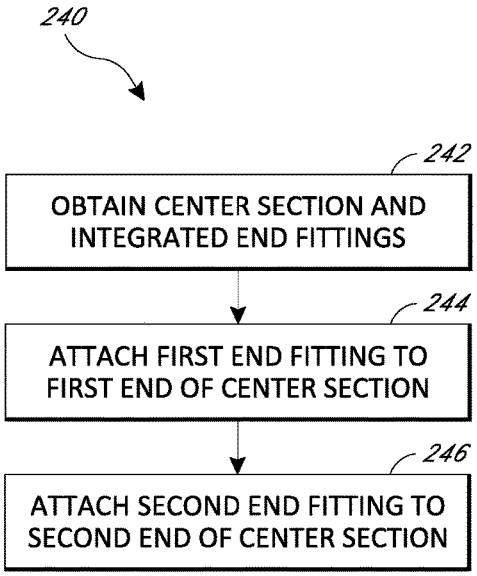

FIG. 10D is a flow chart showing an embodiment of a method 240 for assembling an embodiment of the modular pressure vessel 100. The method 240 may begin with step 242 wherein a center section and one or more end fittings are manufactured or otherwise obtained. The center section 1 may be manufactured using the method 200 described with respect to FIG. 10A. The center section 1 may be integrated with one or more components using the method 220 of FIG. 10B. The one or more end fittings may be integrated with one or more components using the method 230 of FIG. 10C.

The method 240 then moves to step 244 wherein the first end fitting is attached to the center section 1. For example, the end-cap 10 or 15 may be attached to a first end of the center section 1. The end fitting may be attached in various ways, for example by bolting end-cap bolts 13, as described herein. Various sealing mechanisms may be incorporated in step 244, such as the seals 11, 12, as described.

The method 240 then moves to step 246 wherein the second end fitting is attached to the center section 1. For example, the end-cap 10 or 15 may be attached to a second end of the center section 1. The end fitting may be attached in various ways, for example by bolting end-cap bolts 13, as described herein. Various sealing mechanisms may be incorporated in step 246, such as the seals 11, 12, as described. In some embodiments, only one end fitting may be used, for example where one end of the vessel 100 is sealed, and thus step 244 or 246 may be skipped.

In some embodiments, the pressure vessel center section 1 can be manufactured by manufacturing methods different from extrusion methods to efficiently manufacture a pressure vessel 100 with similar shape and with similar function from suitable materials such as, for example, carbon fiber composites or high strength plastic injection molding. In some embodiments, the center section 1 may be made using a drawing process. The discussion of the general methods and materials given herein is intended for illustrative purposes only. Other alternative methods and alternatives will be apparent to those of skill in the art upon review of this disclosure, and are to be included within the spirit and purview of this application.

EXAMPLES

This section provides some example use cases relating to the modular pressure vessel 100, and/or its various components, and associated methods. The following examples are not in any way intended to limit the scope of this disclosure or the claims and merely provided as some example embodiments.

Example 1

Air Management System

An automotive air suspension system requires an air management system in order to fill and empty the vehicle's air springs and in turn control the height of the vehicle. This air management system typically includes one or more air reservoirs (e.g., pressure vessels), one or more electric air compressors, an electronic solenoid valve unit, and an electronic control unit. These components are sometimes mounted individually throughout the vehicle or mounted in combination using a bracket system such as the EXO™ mount system by AccuAir (San Luis Obispo, Calif.), or, for example, AA-EXO-X™ system, by by AccuAir (San Luis Obispo, Calif.). In this example, the modularly constructed pressure vessel 100, 100A as described herein simplifies the packaging of a vehicle air management system by providing an all in-one package with either conventional externally mounted components (electric air compressors, electronic solenoid valve unit, and electronic control unit), or entirely internally integrated components (electric air compressor and electronic solenoid valves).

Example 2

Auxiliary Air System

Many automotive enthusiasts choose to mount an auxiliary air supply system to their vehicle for the purpose of inflating their tires or powering a variety of pneumatic tools or devices. This typically requires one or more air reservoirs (pressure vessels), one or more electric air compressors, and sometimes a means for controlling the stored air such as an electronic solenoid valve unit. In this example, the modularly constructed pressure vessel 100, 100A as described herein simplifies the packaging of an auxiliary air supply system by providing an all in-one package with either conventional externally mounted components (electric air compressors, electronic solenoid valve unit), or entirely internally integrated components (electric air compressor and electronic solenoid valves).

Example 3

Portable Air System

Small portable air supply systems can be found in garages, on job sites, or in factories for the purpose of filling up tires, sports equipment, or powering pneumatic tools or devices. These portable air supply systems usually consist of an air compressor, a reservoir, and a pressure control switch all mounted to one another. Existing systems are very noisy due to the externally mounted air compressor and they are not visually appealing. In this example, the modularly constructed pressure vessel 100, 100A as described herein simplifies the packaging of a portable air supply system by providing an all in-one package with entirely internally integrated components (electric air compressor inside of the air reservoir or pressure vessel). In this particular application, the modularly constructed pressure vessel 100, 100A brings improved aesthetics, simplified installation, and significant noise reduction to portable air supply systems.

Example 4

Air Supply Infrastructures

Industrial distributed air supply infrastructures are utilized to supply pneumatic power to multiple pieces of equipment around factories. These systems typically consist of a central air supply unit that is then distributed long distances through pneumatic plumbing around the factory to supply air to each of the pieces of equipment. The modularly constructed pressure vessel 100, 100A as described herein resolves many of the challenges and costs associated with current industrial distributed air supply infrastructures by providing an all in-one package with entirely internally integrated components (electric air compressor inside of the air reservoir or pressure vessel) that can be utilized at the point of use (on each piece of equipment). This approach eliminates the cost of long distance plumbing infrastructures and expedites the time and reduces the cost required when a piece of equipment needs to be relocated in the factory.

It is to be understood that the described pressure vessels, and the methods for its manufacture as disclosed herein are simply illustrative of some example embodiments. Additional embodiments are disclosed in further detail in the following examples, which are not in any way intended to limit the scope of this disclosure or the claims.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those skilled in the art that parts included in one embodiment are interchangeable with other embodiments; one or more parts from a depicted embodiment may be included with other depicted embodiments in any combination. For example, any of the various components described herein and/or depicted in the figures may be combined, interchanged or excluded from other embodiments.

The processes or steps of any flow charts described and/or shown herein are illustrative only. A person of skill in the art will understand that the steps, decisions, and processes embodied in the flowcharts described herein may be performed in an order other than that described herein. Thus, the particular flowcharts and descriptions are not intended to limit the associated processes to being performed in the specific order described.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A modular pressure vessel, comprising:

a center section having a rounded, longitudinal sidewall, the sidewall defining a longitudinal axis and extending from a first opening at a first end of the center section to a second opening at a second end of the center section that is opposite the first end, a plurality of rails integral with and extending along the center section parallel to the longitudinal axis from a first end at the first opening of the center section to a second end at the second opening of the center section, each rail protruding inwardly from the sidewall, with one or more of the plurality of rails including a first attachment portion at the first end thereof and one or more of the plurality of rails including a second attachment portion at the second end thereof;

a first end-cap configured to removeably attach to the first end of the one or more rails having the first attachment portion; and a second end-cap configured to removeably attach to the second end of the one or more rails having the second attachment portion, wherein the sidewall with attached first and second end-caps define a cavity configured to store therein a pressurized fluid.

2. The modular pressure vessel of claim 1, wherein one or more of the plurality of rails comprises one or more internal attachment portions configured to attach a component in the cavity.

3. The modular pressure vessel of claim 2, wherein the one or more internal attachment portions comprises a threaded bore extending into the one or more of the plurality of rails.

4. The modular pressure vessel of claim 2, wherein the component is a compressor located in the cavity and attached to the one or more internal attachment portions.

5. The modular pressure vessel of claim 1, wherein one or more of the plurality of rails comprises one or more external attachment portions configured to attach the modular pressure vessel with an external structure.

6. The modular pressure vessel of claim 1, wherein the first end-cap comprises an electronic solenoid valve.

7. The modular pressure vessel of claim 1, wherein the first end-cap comprises a pressure relief valve.

8. The modular pressure vessel of claim 1, wherein the first end-cap comprises one or more flow control valves.

9. The modular pressure vessel of claim 1, wherein the first end-cap comprises an electrical bulkhead.

10. The modular pressure vessel of claim 1, wherein the sidewall comprises a fitting port configured to allow for supply of external air inside the cavity.

11. The modular pressure vessel of claim 1, wherein the sidewall comprises an electrical bulkhead.

12. The modular pressure vessel of claim 1, wherein the first end-cap is removeably attached to the first end of the one or more rails having the first attachment portion to seal the first opening, and the second end-cap is removeably attached to the second end of the one or more rails having the second attachment portion to seal the second opening.

13. The modular pressure vessel of claim 1, wherein the plurality of rails comprises eight rails each having the first attachment portion at first ends thereof and the second attachment portion at second ends thereof, with the first end-cap configured to removeably attach to the first ends of the eight rails having the first attachment portion to seal the first opening, and the second end-cap configured to removeably attach to the second ends of the eight rails having the second attachment portion to seal the second opening.

14. A modular pressure vessel, comprising:

a center section having a rounded sidewall with an opening extending therethrough defining a longitudinal axis, a plurality of rails, each rail extending parallel to the longitudinal axis along the center section from a first end to a second end and protruding away from the sidewall;

a first end-cap configured to removeably attach to one or more of the first ends of the plurality of rails; and a second end-cap configured to removeably attach to one or more of the second ends of the plurality of rails, wherein the sidewall with attached first and second end-caps define a cavity configured to store therein a pressurized fluid.

15. The modular pressure vessel of claim 14, wherein the plurality of rails are internal rails located in the cavity.

16. The modular pressure vessel of claim 14, wherein one or more of the plurality of rails comprises one or more attachment portions configured to secure a component in the cavity.

17. The modular pressure vessel of claim 16, wherein the component is a compressor located in the cavity and attached to the one or more attachment portions.

18. The modular pressure vessel of claim 1, wherein one or more of the plurality of rails comprises one or more attachment portions configured to attach the modular pressure vessel with an external structure.

* * * * *